US005235251A

United States Patent [19]

Schlie

[11] Patent Number: 5,235,251

[45] Date of Patent: Aug. 10, 1993

[54] HYDRAULIC FLUID COOLING OF HIGH POWER MICROWAVE PLASMA TUBES

[75] Inventor: LaVerne A. Schlie, Albuquerque, N. Mex.

[73] Assignee: The United States of America as represented by the Secretary of the Air Force, Washington, D.C.

[21] Appl. No.: 743,470

[22] Filed: Aug. 9, 1991

[51] Int. Cl.[5] ..... H01J 7/46

[52] U.S. Cl. ..... 315/112; 315/39; 313/22; 313/36

[58] Field of Search ..... 313/22, 36, 231.01; 315/39, 111.21, 112, 248

[56] References Cited

U.S. PATENT DOCUMENTS

| | | | |
|---|---|---|---|
| 3,554,914 | 1/1971 | Nagy | 252/75 |
| 3,876,901 | 4/1975 | James | 315/3.5 |
| 3,885,984 | 5/1975 | Wright | 106/287 SB |
| 4,045,119 | 8/1977 | Eastgate | 350/96 |
| 4,256,990 | 3/1981 | Busacca et al. | 315/39.51 |
| 4,274,032 | 6/1981 | Dodonov et al. | 315/39.51 |
| 4,500,996 | 2/1985 | Sasnett et al. | 372/19 |
| 4,534,875 | 8/1985 | Rose | 252/71 |
| 4,617,667 | 10/1986 | Penn | 372/35 |
| 4,715,039 | 12/1987 | Miller et al. | 372/37 |
| 5,008,593 | 4/1991 | Schlie et al. | 315/39 |
| 5,012,158 | 4/1991 | Nakatani et al. | 315/112 X |

OTHER PUBLICATIONS

"Hydraulic Fluid as a Liquid Coolant of High Power, cw Microwave (2.45 GHz) Plasma Tubes", L. A. Schlie, Rev Sci Inst. 62(2), 542 (Feb. 1991).

*Primary Examiner*—Steven Mottola

*Attorney, Agent, or Firm*—Bobby D. Scearce; Thomas L. Kundert

[57] ABSTRACT

A coolant system for a high power microwave excited plasma tube is described which comprises hydraulic fluid in a coolant system structure for flowing the fluid into heat exchange relationship with the plasma tube. Such a coolant system can operate over the temperature range of −50° to 150° C. and may provide excellent optical transmission from 5700 to 10000 Å, thus being useful for cw or pulsed solid state laser pumps.

6 Claims, 2 Drawing Sheets

HYDRAULIC FLUID COOLING OF HIGH POWER MICROWAVE PLASMA TUBES

RIGHTS OF THE GOVERNMENT

The invention described herein may be manufactured and used by or for the Government of the United States for all g mental purposes without the payment of any royalty.

CROSS REFERENCE TO RELATED APPLICATION

The invention described herein is related to copending application Ser. No. 07/553,928 filed Jul. 13, 1990, and entitled LIQUID COOLANT FOR HIGH POWER MICROWAVE EXCITED PLASMA TUBES, now U.S. Pat. No. 5,055,741 dated Oct. 8, 1991.

BACKGROUND OF THE INVENTION

The present invention relates generally to systems for generating microwave excited plasma discharges, and more particularly to novel materials and systems for effectively cooling high power microwave plasma tubes.

Microwave excited electrodeless discharges exhibit many attractive features for plasma excitation (continuous wave (cw) and pulsed) of low and high pressure gas in both lasers and lamps. First, such discharges appear to be inherently more stable in larger volumes and higher pressures than other types of d.c. self-sustained discharges, which stability can enable significant increases in volumetric power loading levels into the plasma. Second, the absence of metal electrodes allows discharges to be contained within either quartz or ceramic tubes or other low microwave absorbing dielectrics, and are therefore to be particularly attractive for corrosive gases such as halogens and metal vapors. Electrodeless discharges may also provide greatly enhanced stable (quiescent) plasmas in large volumes, discharge pressure scaling, increased microwave power loading per unit volume, greatly reduced gas contamination, longer lifetimes for reliable operation, and elimination of cataphoresis (particularly relevant to metal vapor lasers).

Of the aforementioned microwave discharge properties, the increase in power loading into the plasma is a prominent consideration. Increased power loadings, however, may result in temperatures (>1000° C. for quartz) sufficient to melt the plasma container walls (typically quartz or ceramic) or otherwise to cause structural failure (thermally induced cracks or softening) in the plasma containment apparatus. Such failures may occur for uncooled cw microwave power loadings greater than a few tens of watts/cc. Further, very high plasma tube wall temperatures can affect the kinetics of the plasma, a notable example being the $CO_2$ laser. Consequently, gaseous or liquid cooling is essential for the plasma containment walls. Concentric high gaseous flow cooling is usually ineffective in removing excess heat because of low heat transfer between the containment walls and the gaseous coolant, and may also produce high noise levels.

Liquids have much greater cooling capacities than gases and make direct substantial contact with the plasma tube walls. Conventionally used liquids, however, do not exhibit all the desirable optical, microwave and physical properties, and are generally either high microwave absorbers (e.g., water at 2450 MHz), dangerously unsafe (e.g., $CS_2$, $CCl_4$), flammable (e.g., benzene, other medium weight hydrocarbons, pentane, and butane), and/or non-transmissive in the ultraviolet (UV).

Desirable properties of liquid coolant for microwave excited lamps include good transmission in the desirable spectral region (UV, visible or infrared (IR)), low microwave absorption at the microwave operating frequency, ability to withstand high cw and pulsed UV and visible radiation fluences, non-toxicity and nonflammability, large IR absorption, and desirable physical and chemical properties (low viscosity, reasonable density, low vapor pressure, large heat capacity, high thermal conductivity). The invention herein substantially solves the problems suggested above with conventional liquid cooling for microwave excited plasmas by providing coolant comprising commercially available hydraulic fluid exhibiting most of the desired optical/microwave Properties mentioned above, and can be used over a wide temperature range, −50° to 150° C.

It is therefore a principal object of the invention to provide safe and reliable liquid cooling for high power microwave excited plasma tubes of pulsed or cw operational mode.

It is a further object of the invention to provide liquid coolant for high power microwave excited plasma tubes with application over a wide operating temperature range.

It is another object of the invention to provide high power microwave excited plasma tube liquid coolant having low microwave absorption.

It is another object of the invention to provide liquid coolant producing significant absorption of IR radiation emitted from high power microwave excited plasma tubes.

These and other objects of the invention will become apparent as a detailed description of representative embodiments proceeds.

SUMMARY OF THE INVENTION

In accordance with the foregoing principles and objects of the invention, a coolant system for a high power microwave excited plasma tube is described which comprises hydraulic fluid in a coolant system structure for flowing the fluid into heat exchange relationship with the plasma tube. Such a coolant system can operate over the temperature range of −50° to 150° C. and may provide excellent optical transmission from 5700 to 10000 Å, thus being useful for cw or pulsed solid state laser pumps.

DESCRIPTION OF THE DRAWINGS

The invention will be more clearly the following detailed description of representative embodiments thereof read in conjunction with the accompanying drawings wherein.

DETAILED DESCRIPTION

Hydraulic fluids are by nature and purpose essentially incompressible, freely flowing under normal conditions and good lubricants. Each type of hydraulic fluid is designed to satisfy a specific application such as in automobile brakes, airplanes and various other industrial applications. The viscosities of these fluids vary significantly from about 1 to more than 100 centipoise over temperature ranges of −50° to 150° C. Hydraulic fluids are characterized by high dielectric (insulating) strength (>35 KV), excellent corrosion protection, long term oxidation, specific gravities of 0.8–0.9, relatively high boiling points (>150° C.), high flash points (>100° C.), good low temperature operation (<−50° C.), good heat conductivity, reasonable vapor pressure and non-foaming features. Small amounts of water (~2%) are often absorbed in hydraulic fluids resulting in slight decreases in boiling point (<10° C.) and increases (<10%) in microwave absorption at 2450 MHz. Hydraulic fluids generally are non-toxic, non-flammable, environmentally safe and inexpensive.

In accordance with a governing principle of the invention, it was discovered that commercially available hydraulic fluid may be extremely useful as a liquid coolant in cooling high power microwave (2450 MHz) plasma tubes. Tests performed herein in demonstration of utility and operability of the invention utilized a type of hydraulic fluid named "Petro-Based Hydraulic Fluid" (MIL-H-5606E), commercially available (Penreco Corp) as a low temperature hydraulic oil designated "Frigi-Tranz Fluid". It is noted however that other types of hydraulic fluids may be used in the practice of the invention as would occur to the skilled artisan guided by these teachings.

Figure 1A:
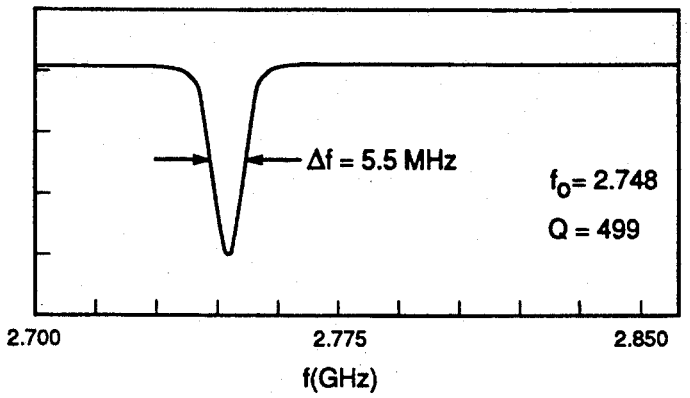
FIGS. 1*a* and 1*b* show resonant microwave cavity data respectively for an empty quartz tube and a tube containing hydraulic fluid.
Figure 1B:
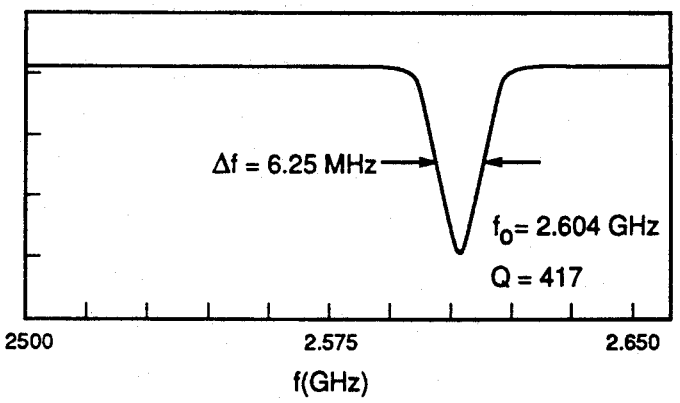

An important advantage of hydraulic fluid which renders it particularly desirable as a coolant for microwave excited plasma tubes in accordance with the invention resides in its negligible absorption of microwave energy at 2450 MHz, and high microwave power loading per unit volume resulting in high plasma radiation emitted in the visible and near infrared (IR) spectral regions. Microwave energy absorption by the demonstration hydraulic fluid was measured by two separate methods, viz., (1) a microwave cavity technique (Fein et al, "A Numerical Method for calibrating Microwave Cavities for Plasma Diagnostics—Part I", IEEE Trans Micr Theory and Tech 20:22 (1972) and Heald et al, *Plasma Diagnostics,* Wiley & Sons, New York (1954), Chap 5), and (2) a balanced slotted line method (von Hippel, *Dielectric Materials and Applications,* Technology Press of MIT and Wiley & Sons, New York (1954). Chap 2). In method (1). the shift in resonant frequency $f_o$ for the microwave cavity established an approximate value for the dielectric constant ($\epsilon'$) while the change in Q of the cavity gives an estimate for the absorption ($\epsilon''$) for the hydraulic fluid. FIGS. 1*a* and 1*b* show data respectively for a quartz resonant cavity tube without and with hydraulic fluid in the cavity. The microwave resonant cavity tests gave initial estimates to $\epsilon'$ and $\epsilon''$ close to those obtained using the more accurate measurement method (2) outlined by von Hippel. Using the analysis approach of von Hippel, the real and imaginary components of the dielectric constant for hydraulic fluid were determined as $\epsilon'=1.6517$ and tan $\delta=\epsilon''/\epsilon'=1.87\times10^{-4}$ giving $\epsilon''=3.089\times10^{-4}$ at 2450 MHz. With the small value for $\epsilon''$, the microwave absorption may be given by the simplified expression, $$\epsilon=k\epsilon''/2\epsilon'$$

where $k=\omega(\mu_o\epsilon_o\epsilon')^{\frac{1}{2}}$ and $\omega$ is the radian frequency. $\mu_o$ and $\epsilon_o$ are respectively the permeability and permittivity of free space. The resulting microwave absorption (≦0.1 watts/cm absorbed per KW incident microwave power) is very low and comparable to the value reported for quartz. The low value for the demonstration hydraulic fluid suggests good liquid coolant properties for microwave excited plasma tubes.

Figure 2:
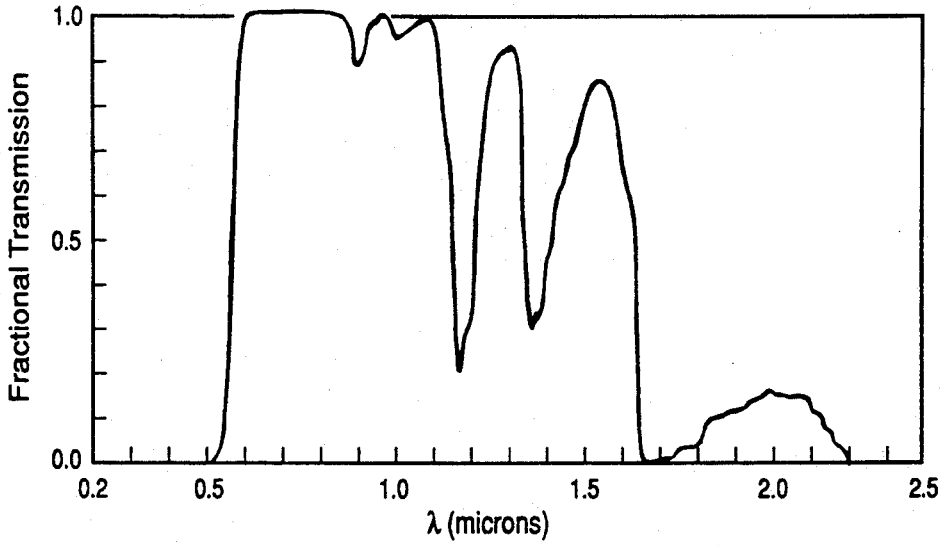
FIG. 2 shows spectral transmission of hydraulic fluid used in demonstration of the invention.

Referring now to FIG. 2, shown therein is the transmission spectra for the demonstration hydraulic fluid in the visible and near IR spectral region, using a Cary Model 2400 spectrometer with a test cell length of 1 cm. The hydraulic fluid tested in demonstration of the invention has a high threshold wavelength for transmission at 5700Å. From this threshold wavelength to approximately 1.1 microns, the transmissive behavior is nearly 100% except for a region near 0.9 microns. For higher IR wavelengths, two strong absorptions are centered at 1.2 and 1.4 microns, significant transmission peaks at 1.3 and 1.55 microns, and a cut-off at 1.65 microns. In the region from 1.75 to 2.2 microns, there is a small transmission window (~15%). No special cleaning of this particular hydraulic liquid was performed. A red color for the fluid is obvious from the information shown on FIG. 2. The relatively large IR absorption at wavelengths greater than 1.1 microns indicates that significant fractions of plasma IR radiation will be absorbed in the hydraulic fluid coolant. The refractive index in the visible (5889Å) using a Bausch-Lomb Abbe-3L refractometer was determined to be 1.47.

The resistivity of the demonstration hydraulic fluid was determined to be greater than 100 MΩ.cm using a Bardstead Model PM-70 CB conductivity bridge meter. No degradation of the fluid occurred when conductivity measurements were made which indicates resistance to high microwave power levels (corresponding to high electric field intensities).

Figure 3:
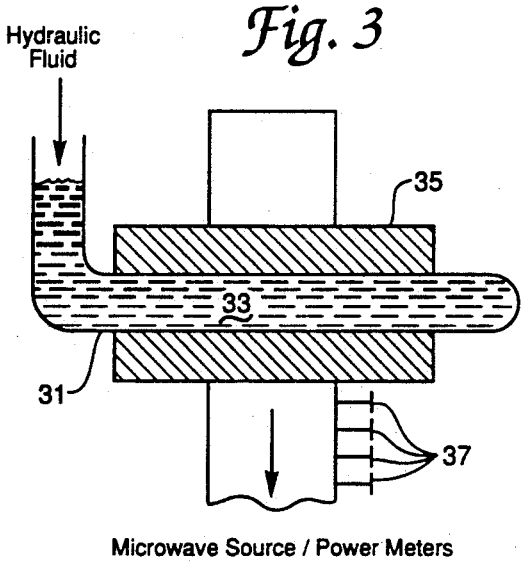
FIG. 3 shows a quartz finger and microwave applicator arrangement utilized for testing microwave power absorption of the demonstration hydraulic fluid.

In order to test the hydraulic fluid in a 2450 MHz microwave environment, an open 2.5 cm diameter, quartz finger 31 of hydraulic fluid 33 was placed in a microwave applicator 35 (simply a piece of rectangular waveguide with a circular hole through the wider side thereof) as shown in FIG. 3. Microwave power (2450 MHz) of 1 KW was applied to quartz finger 31 for five minutes with no noticeable effect. Tuning stubs 37 were placed between the microwave source and applicator 35 to maximize absorption in fluid 33. This trial was repeated with a power setting of 1.5 KW with no noticeable heating of fluid 33. Two more trials conducted at 2.5 KW for 30 minutes showed less than 10 watts of absorbed microwave power in fluid 33. No significant heating of the quartz tube was observed.

Figure 4:
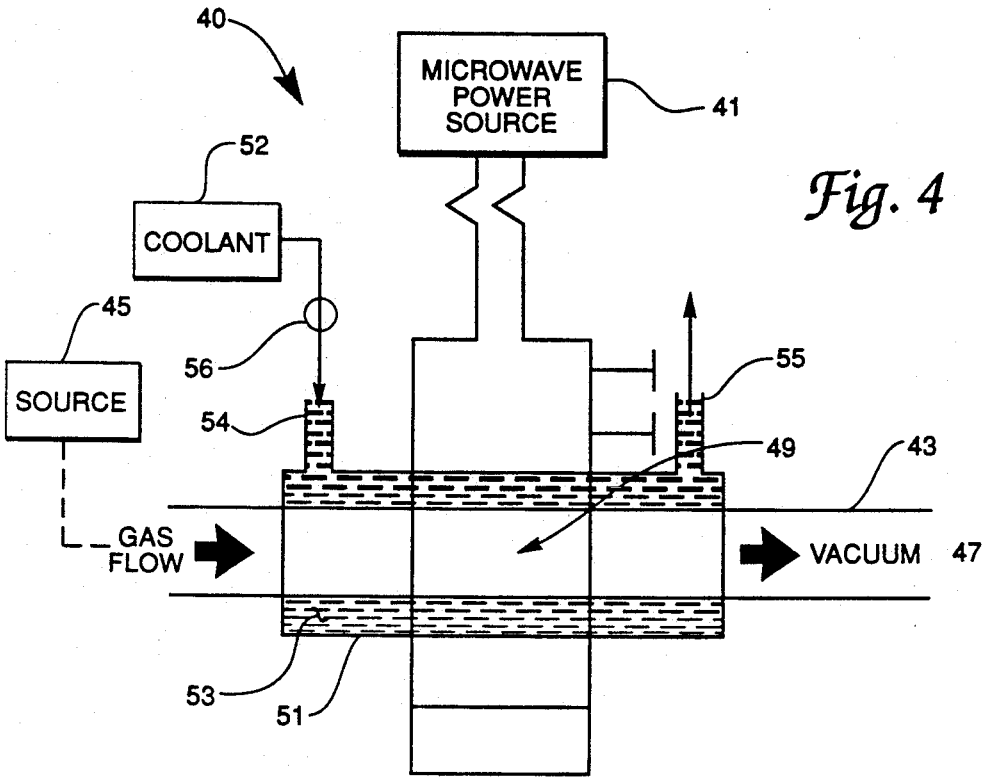
FIG. 4 shows schematically a representative microwave excited plasma system incorporating the invention.

Referring now to FIG. 4, shown schematically is a 2450 MHz microwave excited plasma system 40 incorporating the invention herein including a concentric tube liquid cooling jacket for a quartz plasma tube. The FIG. 4 system is representative of a resonant cavity type plasma system including microwave power source 41; quartz plasma tube 43 (1 cm O.D. by 1 mm wall) is operatively connected at a first end to gas source 45 and at the second end to vacuum means 47, and defines active plasma discharge region 49. Source 45 conventionally comprises nitrogen, inert gas, molecular gas, vaporous metal or halide salts suitable for supporting a plasma within region 49. Cooling jacket 51 (1.4 cm I.D. by 1 mm wall) surrounding plasma tube 43 and region 49 is operatively connected to coolant source 52 of hydraulic fluid and defines region 53 having inlet 54 and outlet 55 for containment and flow of hydraulic fluid into contact with the outer surface of tube 43. In demonstration of the invention using the system depicted in FIG. 4, both tube 43 and jacket 51 were quartz, which is transparent to microwaves. All quartz tubing was sealed with rubber O-rings. No vacuum leaks or quartz structural failures occurred due to thermal expansion. A small Neslab RTE-8 refrigeration unit 56 was used to both circulate and cool the hydraulic fluid. The hydraulic fluid was maintained at about 20° C.

If nitrogen gas (1–10 torr) is flowed through tube 43, an intense cw microwave plasma is produced along with substantial wall heating and power absorption greater than 1 KW. A bright red emission was observed when the plasma was viewed through the hydraulic fluid, consistent with the spectral transmissive information of FIG. 2. Visualization of the nitrogen afterglow through only the quartz flow tube gave the typical yellow first positive $N_2$ (B to A) emission approximately 1 meter downstream to active discharge excitation region 49. The radiated infrared heat was greatly reduced along with negligible ozone smell. Region 49 was approximately 3 cm long and 1 cm diameter. The resulting power loading was 200 watts/cc over a volume of 14.7 cc.

During more than an hour at 2.8 KW transmitted microwave power into a nitrogen plasma within region 49, no damage to tube 43, jacket 51 or the hydraulic fluid occurred, which shows the negligible microwave absorptive property of hydraulic fluid.

Figure 5:
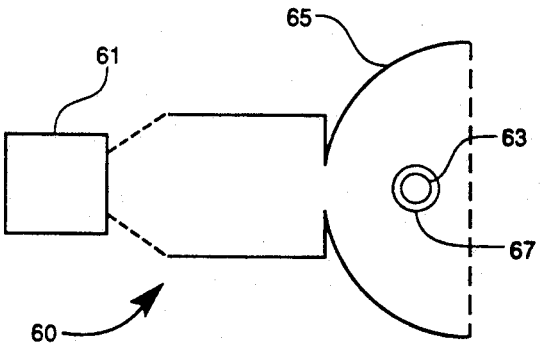
FIG. 5 shows schematically another representative high power microwave excited plasma tube configuration which may accommodate liquid cooling in accordance with the teachings of the invention.

FIG. 5 shows a schematic of a system representative of other high power microwave excited plasma tube configurations which may accommodate liquid cooling in accordance with the teachings of the invention. System 60 of FIG. 5 may include microwave power source 61, electrodeless quartz plasma tube 63, and reflector 65 of suitable shape (e.g. elliptical, spherical, parabolic, involute). Jacket 67 surrounds plasma tube 63 for flowing hydraulic fluid coolant into contact with the outer surface of tube 63 in accordance with the invention. It is noted that the cooling configurations hereinabove discussed are only representative of numerous structures accommodating liquid flow according to the invention. Other flow schemes occurring to the skilled artisan practicing the invention can be accomplished in other microwave excited plasma tube configurations wherein the liquid coolant is flowed along the outer boundary of the plasma tube using coaxial, transverse or other flow, and are considered within the scope hereof.

The results presented here clearly show that hydraulic fluid can serve as an excellent liquid coolant of microwave excited, high power plasmas. The spectral transmissive properties of hydraulic fluids, however, prevent their uses as a coolant for ultraviolet emitting lamps. Alternatively, this coolant may be very useful for lamps requiring emission at wavelengths greater than 5700 Å such as in solid state or glass lasers.

The invention therefore provides a coolant system comprising hydraulic fluid for microwave excited plasma tubes. It is understood that modifications to the invention may be made as might occur to one with skill in the field of the invention within the scope of the appended claims. All embodiments contemplated hereunder which achieve the objects of the invention have therefore not been shown in complete detail. Other embodiments may be developed without departing from the spirit of the invention or from the scope of the appended claims.

I claim:

1. A coolant system for a high power microwave excited plasma tube which comprises:
   (a) a source of hydraulic fluid, wherein said hydraulic fluid has low microwave absorption at 2450 MHz; and
   (b) means for circulating said hydraulic fluid into heat exchange relationship with said plasma tube.

2. A coolant system for a high power microwave excited plasma tube which comprises:
   (a) a source of hydraulic fluid, wherein said hydraulic fluid is characterized by high absorption of infrared radiation; and
   (b) means for circulating said hydraulic fluid into heat exchange relationship with said plasma tube.

3. In a microwave excited plasm system including a plasma tube for sustaining a plasma therein and a cooling system for cooling said plasma tube, an improvement wherein said cooling system comprises:
   (a) a source of hydraulic fluid, wherein said hydraulic fluid has low microwave absorption at 2450 MHz;
   (b) conduit means for conducting hydraulic fluid from said source and into heat exchange relationship with said plasma tube; and
   (c) pump means for circulating said hydraulic fluid through said conduit means and into heat exchange relationship with said plasma tube.

4. In a microwave excited plasm system including a plasma tube for sustaining a plasma therein and a cooling system for cooling said plasma tube, an improvement wherein said cooling system comprises:
   (a) a source of hydraulic fluid, wherein said hydraulic fluid is characterized by high absorption of infrared radiation;
   (b) conduit means for conducting hydraulic fluid from said source and into heat exchange relationship with said plasma tube; and
   (c) pump means for circulating said hydraulic fluid through said conduit means and into heat exchange relationship with said plasma tube.

5. The system of claim 2 wherein said hydraulic fluid is characterized by high optical transmission to radiation in the wavelength range of 5700 to 10000 Å.

6. The system of claim 4 wherein said hydraulic fluid is characterized by high optical transmission to radiation in the wavelength range of 5700 to 10000 Å.

* * * * *